US010549441B2

(12) United States Patent
Li et al.

(10) Patent No.: US 10,549,441 B2
(45) Date of Patent: Feb. 4, 2020

(54) CUTTING DEVICE OF INTEGRATED PAPER-PLASTIC BAG CUTTING AND SEALING MACHINE

(71) Applicant: EASYSEAL MEDICAL TECHNOLOGY CO., LTD, Zibo (CN)

(72) Inventors: Daihua Li, Zibo (CN); Jianxi Zhao, Zibo (CN); Shuibing Zhao, Zibo (CN); Zhushuai Shao, Zibo (CN)

(73) Assignee: EASYSEAL MEDICAL TECHNOLOGY CO., LTD, Zibo (CN)

( * ) Notice: Subject to any disclaimer, the term of this patent is extended or adjusted under 35 U.S.C. 154(b) by 64 days.

(21) Appl. No.: 16/072,184

(22) PCT Filed: Aug. 31, 2017

(86) PCT No.: PCT/CN2017/099867
§ 371 (c)(1),
(2) Date: Jul. 24, 2018

(87) PCT Pub. No.: WO2018/041210
PCT Pub. Date: Mar. 8, 2018

(65) Prior Publication Data

US 2019/0344462 A1 Nov. 14, 2019

(30) Foreign Application Priority Data

Aug. 31, 2016 (CN) ..... 2016 1 0792503
Aug. 31, 2016 (CN) ..... 2016 2 1024778 U

(51) Int. Cl.
*B26D 1/18* (2006.01)
*B31B 70/14* (2017.01)
(Continued)

(52) U.S. Cl.
CPC ..... *B26D 1/18* (2013.01); *B26D 7/26* (2013.01); *B31B 70/14* (2017.08); *B65B 61/08* (2013.01)

(58) Field of Classification Search
CPC . B26D 1/18; B26D 1/185; B26D 1/04; B26D 1/045; B26D 1/12; B26D 1/125; B26D 1/14
See application file for complete search history.

(56) References Cited

U.S. PATENT DOCUMENTS 3,984,211 A * 10/1976 Hawkins ..... B26D 1/04 451/70
4,593,589 A * 6/1986 Gherardi ..... A24C 5/473 83/168
(Continued)

FOREIGN PATENT DOCUMENTS

CN 202922637 U 5/2013
CN 204136089 U 2/2015
(Continued)

*Primary Examiner* — Jason Daniel Prone
*Assistant Examiner* — Richard D Crosby, Jr.
(74) *Attorney, Agent, or Firm* — Gokalp Bayramoglu

(57) ABSTRACT

A cutting device of an integrated paper-plastic bag cutting and sealing machine includes a sliding bracket and a cutting knife. The sliding bracket is connected to a horizontal displacement driving mechanism. The sliding bracket is formed by connecting an upper plate with a rear plate. The sliding block is mounted on the rear plate through a connecting shaft and is capable of sliding back and forth along the connecting shaft, front and rear snapping grooves are arranged on the connecting shaft along the length direction. A cutting knife is mounted on the sliding block, its lowest position is lower than the bottom surface of the sliding block. A spring positioning column is mounted on the sliding block, the top end of the spring positioning column passes through the shaft hole wall of the connecting shaft of the
(Continued)

sliding block and tightly presses against the connecting shaft.

20 Claims, 4 Drawing Sheets

(51) Int. Cl.
*B65B 61/08* (2006.01)
*B26D 7/26* (2006.01)

(56) References Cited

U.S. PATENT DOCUMENTS 4,864,906 A * 9/1989 Hall ..... B26D 1/18 83/886
4,979,838 A * 12/1990 Yokota ..... B41J 11/706 101/226
5,503,053 A * 4/1996 Onishi ..... B26D 1/245 83/488
5,853,529 A * 12/1998 Yeh ..... B26D 1/18 156/512
5,881,623 A * 3/1999 Otani ..... B26D 1/245 83/455
6,089,136 A * 7/2000 Hinojosa ..... B26D 1/185 83/453
7,815,382 B2 * 10/2010 Monclus ..... B26D 1/0006 400/621
2008/0047407 A1 * 2/2008 Muller ..... B26D 7/2635 83/34
2009/0151534 A1 * 6/2009 Rooke ..... B26D 5/04 83/663
2010/0218658 A1 * 9/2010 Myers ..... B26D 1/0006 83/174
2011/0036219 A1 * 2/2011 Finnell ..... B26D 1/18 83/13
2012/0297945 A1 * 11/2012 Cordero ..... B26D 1/245 83/56
2014/0326115 A1 * 11/2014 Broad ..... D01G 1/10 83/13
2017/0087890 A1 * 3/2017 Masuda ..... B41J 11/70
2018/0079097 A1 * 3/2018 Oiwa ..... B26D 1/245

FOREIGN PATENT DOCUMENTS

CN 105773691 A 7/2016
CN 106217443 A 12/2016
CN 206011211 U 3/2017

* cited by examiner

CUTTING DEVICE OF INTEGRATED PAPER-PLASTIC BAG CUTTING AND SEALING MACHINE

CROSS REFERENCE TO RELATED APPLICATIONS

This application is the national phase entry of International Application No. PCT/CN2017/099867, filed on Aug. 31, 2017, which is based upon and claims priority to Chinese Patent Application No. 201610792503.6 and No. 201621024778.7, both filed on Aug. 31, 2016, the entire contents of which are incorporated herein by reference.

TECHNICAL FIELD

The present invention relates to a cutting device of an integrated paper-plastic bag cutting and sealing machine, which belongs to the field of paper-plastic bag cutting and sealing equipment.

BACKGROUND

The medical sealing machines are widely used in the disinfection of medical centers and has features such as continuous sealing.

At present, there are independent paper-plastic bag cutting machines in the market, and also independent paper-plastic bag sealing machines. Thus, in the specific operation, paper-plastic bags with different sizes and different lengths need to be used for different disinfection devices. Firstly, the paper-plastic bag needs to be cut on the cutting machine and then sealed on the independent sealing machine, which is inconvenient to use, and has the problems such as inefficient working and occupies large space.

Subsequently, research and development personnel have developed an integrated paper-plastic bag cutting and sealing machine that integrates a cutting function with a sealing function. The integrated machine includes a paper entering device (with adjustable paper entering length), a cutting device, a paper feeding device and a sealing device. Under the action of the paper entering device, the paper-plastic bag enters the upper and lower dual-belt conveying mechanism of the paper feeding device along the Y-axis direction, and the cutting device moves along the X-axis direction (currently, drive belt is usually used to drive the cutting device to move). The paper-plastic bag material is cut, and the paper-plastic bag cut out is driven by belts of the dual-belt conveying mechanism to enter the sealing device along the X-axis direction to be sealed. A series of actions of cutting and sealing the paper-plastic bag may be realized through the integrated paper-plastic bag cutting and sealing machine.

However, the above-mentioned integrated paper-plastic bag cutting and sealing machine may have the following defects during use.

Currently, since the paper-plastic bags required to be sealed are usually coded on the outside of the sealing position, the distance between the sealing position and the edge of the paper-plastic bag is generally 1 to 4 cm, and the position of the cutting knife in the cutting device is relatively close to the outside. However, the distance between the sealing position and the edge of the paper-plastic bag is obviously too large for the paper-plastic bag that is unnecessary to be coded on the outside of the sealing line, so that a large amount of paper-plastic bag material is wasted during the cutting process of the paper-plastic bag. However, since the position of the cutting device in the traditional integrated paper-plastic bag cutting and sealing machine is fixed, it is difficult to adjust the position of the cutting knife to reduce the distance between the sealing position and the edge of the paper-plastic bag.

SUMMARY

The technical problem to be solved by the present invention is to overcome the deficiencies in the prior art and provide a cutting device of an integrated paper-plastic bag cutting and sealing machine, which may conveniently and rapidly adjust the position of the cutting knife according to actual needs, and effectively reduce the waste of the paper-plastic bag materials.

The cutting device of the integrated paper-plastic bag cutting and sealing machine of the present invention includes a sliding bracket and a cutting knife, the sliding bracket is connected to a horizontal displacement driving mechanism, the horizontal displacement driving mechanism is connected to the control system of the integrated paper-plastic bag cutting and sealing machine. The sliding bracket is formed by connecting an upper plate and a rear plate. A sliding block is mounted on the rear plate through a connecting shaft and is capable of sliding forth and back along the connecting shaft. The front and rear snapping grooves are arranged along the length direction (i.e. along the Y-axis direction) on the connecting shaft. The cutting knife is mounted on the sliding block and moves along with the sliding block, the lowest position of the cutting knife is lower than the bottom surface of the sliding block. A spring positioning column is mounted on the sliding block, the top end of the spring positioning column passes through the shaft hole wall of the connecting shaft of the sliding block and tightly presses against the connecting shaft.

In the cutting device of the present invention, since the sliding block slides back and forth along the connecting shaft (i.e., slides along the Y-axis direction), the cutting knife may realize forward and backward displacement under the action of the sliding block. During the sliding of the sliding block, the spring positioning column is always under pressure. When the sliding block moves to a position of a certain snapping groove, the spring positioning column will spring into the snapping groove by itself under the action of its own elastic force, so that the positions of the sliding block and the sliding bracket are relatively fixed, the positioning of the cutting knife is realized. When the spring positioning column is snapped in the snapping groove at the rear part of the connecting shaft (i.e., the snapping groove near the rear plate), the cutting device may be used to cut the traditional paper-plastic bags coded on the outside of the sealing position; when the paper-plastic bag to be cut is not required to be coded on the outside of the sealing position, the slide block is moved forward along the Y-axis direction, the spring positioning column is detached from the snapping groove in the rear part of the sliding block and enters the snapping groove in the front part (i.e., the snapping groove near the cutting knife). The adjustment of the sliding block and the cutting knife are achieved, so that the cutting position will be advanced. The distance between the sealing position of the cut paper-plastic bag and the edge of the paper-plastic bag will be reduced, effectively overcoming the problem of a large amount of waste of paper-plastic bag materials caused by the fixed position of the cutting device in the traditional integrated paper-plastic bag cutting and sealing machine, reducing the production cost.

Preferably, the horizontal displacement driving mechanism uses a pulley transmission mechanism. The sliding bracket further includes an upper pressing plate. The upper pressing plate is located above the upper plate. The upper pressing plate is provided with a mounting groove for assembly of the transmission belt in the pulley transmission mechanism. The transmission belt is placed between the upper pressing plate and the upper plate, and the upper pressing plate is fixedly connected to the upper plate through the fixing member. The cutting device is driven by the transmission belt to move along the X-axis direction to complete the cutting of the paper-plastic bag.

Preferably, a base plate is mounted behind the pulley transmission mechanism, a horizontal sliding groove is provided on the base plate, a slider is arranged on the back surface of the rear plate of the sliding bracket. The slider is located in the horizontal sliding groove and may slide left and right along the X-axis direction in the horizontal sliding groove. The horizontal sliding groove plays a good guiding role for the sliding bracket.

Preferably, an adjusting bolt is mounted on the upper plate, a second nut is mounted on the adjusting bolt at a part located above the upper plate, a lower end of the adjusting bolt presses against the sliding block, the position of the sliding block may be adjusted by the adjusting bolt, thereby achieving the function of adjusting the height of the cutting knife.

In actual use, a manual operation may be used to poke the sliding block to achieve a change in position of the cutting knife. Of course, an automatic way may be used to adjust the position of the cutting knife. The specific solution is as follows:

A pin is arranged on any of the left and right end surfaces of the sliding block along the X-axis direction. A pin poking mechanism is provided corresponding to the pin. The pin poking mechanism may be used to poke the pin, so that the automatic adjustment of the position of the cutting knife can be achieved. The following structural forms of the pin poking mechanism are preferred in the present invention: the pin poking mechanism includes a pin pull plate, a cam, a motor and a fixing bracket. The motor is mounted on the fixing bracket, the cam is mounted on the output shaft of the motor. The pin pull plate is assembled with the cam and is driven by the cam to move back and forth in the Y-axis direction. A pin inserting slotted hole is arranged on the pin pull plate at an end close to the pin, the hole diameter of the pin inserting slotted hole is larger than the diameter of the pin. The front and rear limiting switches are mounted on the fixing bracket along the Y-axis direction. The two limiting switches and the motor are connected to the control system of the integrated paper-plastic bag cutting and sealing machine. The rotation action of the output shaft of the motor may be converted into forward and backward movement of the pin pull plate along the Y-axis direction through the cam. The pin in the pin inserting slotted hole on pin pull plate and the sliding block move back and forth along with the pin pull plate. The specific process of adjusting the position of the cutting knife by the pin poking mechanism is as follows.

When the cutting knife needs to be adjusted from the rear to the front (along the Y-axis direction), the sliding bracket is firstly moved to a side of the pin pull plate, the pin on the sliding block is inserted into the pin inserting slotted hole at the front end of the pin pull plate (In an abnormal situation, if the pin on the side of the sliding block is laterally non-coaxial with the pin inserting slotted hole at the front end of the pin pull plate, when the sliding bracket moves to the side of the pin pull plate, the pin on the sliding block cannot be inserted into the pin inserting slotted hole at the front end of the pin pull plate. At this time, the motor needs to be started, the pin pull plate is driven by the motor to move, and finally the pin is inserted into the pin inserting slotted hole), then the motor is started by the control system, the pin pull plate is driven to move forward by the cam. When the pin pull plate moves to the forefront, the spring positioning column on the sliding block just reaches the position of the snapping groove at the front of the connecting shaft and springs into the snapping groove. Meanwhile, the rear end of the pin pull plate just reaches the position of the front limiting switch. At this time, the front limiting switch will transmit the signal to the control system of the integrated paper-plastic bag cutting and sealing machine. The motor is stopped by the control system and the sliding block stops moving, the positioning of the cutting knife is realized. When the cutting knife needs to be adjusted from the front to the rear, the sliding bracket also needs be moved to the side of the pin pull plate first, so that the pin is inserted into pin inserting slotted hole (the same as the above-mentioned, in the abnormal situation, the motor needs to be started, making the pin to be inserted into the pin inserting slotted hole), then the motor is started, the pin pull plate moves to the most rear. At this time, the spring positioning column on the sliding block springs into snapping groove at the rear part of the connecting shaft. Meanwhile, the rear end of the pin pull plate just reaches the position of the rear limiting switch, the control system stops the motor and positions the cutting knife.

Preferably, the limiting switch is a contact switch. A groove is formed on the upper surface of the pin pull plate. When the pin pull plate moves backward to the rear contact switch along the Y-axis direction, the front contact switch is just located in the above-mentioned groove.

Preferably, the cam uses an eccenter, an eccentric hole matched with the eccenter is arranged on the pin pull plate, the eccenter is assembled in the eccentric hole through the bearing. The rotation action of the output shaft of the motor is converted into the forward and backward movement of the pin pull plate along the Y-axis direction by the eccenter.

Preferably, one end of the spring is fixed on the plate surface of the pin pull plate close to the sliding bracket through the fixing member, the other end of the spring is mounted on the rack of the integrated paper-plastic bag cutting and sealing machine.

Preferably, an obliquely upward guiding plate and a photoelectric switch are mounted on the rack of the integrated paper-plastic bag cutting and sealing machine. The photoelectric switch is connected to the control system of the integrated paper-plastic bag cutting and sealing machine. A side of the sliding bracket near the guiding plate has an external convex plate, when the sliding block moves upward along the guiding plate to a position that a cutting surface of the cutting knife is higher than a plane of a paper-plastic bag in a paper feeding device of the integrated paper-plastic bag cutting and sealing machine, the photoelectric switch may sense the external convex plate. In the practical application, a roller may be mounted at the lower part of the sliding block, the position of the roller is close to the rear plate. When the integrated paper-plastic bag cutting and sealing machine is merely used to perform the sealing operation, in order to avoid the cutting knife accidentally touching the paper-plastic bag to be sealed and damaging the paper-plastic bag, the position of the cutting knife may be moved upwards through the present preferred solution, so that the cutting surface of the cutting knife is higher than the plane of the paper-plastic bag in the paper feeding device. The specific working process is as follows. The horizontal displacement driving mechanism is started through the control system, the whole cutting device is driven to move to the guiding plate along the X-axis direction, when reaching the position of the guiding plate, the sliding block with roller will move obliquely upwards along the guiding plate, the position of the cutting knife on the sliding block is raised (moves along the Z-axis direction), so that the cutting surface of the cutting knife is higher than the plane of the paper-plastic bag in the paper feeding device, at this time, the photoelectric switch senses the external convex plate, and transmits the signal to the control system, the movement of the horizontal displacement driving mechanism is stopped through the control system, and finally the entire cutting device stops moving.

In the present invention, the top part of the sliding block can be mounted with an elastic member, the elastic member is in a compressed state during the movement of the cutting knife along the guiding plate. Wherein, spring top bead may be used as the elastic member, and springs may also be used. When the cutting action needs to be performed through the cutting knife, the horizontal displacement driving mechanism is started by the control system to drive the entire cutting device to move away from the guiding plate along the X-axis. During the movement, the elastic member will exert downward force to the sliding block under the action of its own elastic force. The slide block is deflected around the connecting shaft under the action of the elastic member, so that the position of the cutting knife is reduced until the cutting knife returns to the initial position (i.e., the position of the cutting knife in the cutting state).

A round cutting blade may be used as the cutting knife of the present invention, the round cutting blade is mounted on the sliding block by a fastener. Under normal circumstances, the cutting knife will become blunt or worn after being used for a period of time. If a conventional knife is used, the knife needs to be replaced periodically. This solution greatly extends the service life of the cutting knife by using a round cutting blade. When a common cutting surface of the round cutting blade is damaged, the fastener may be loosened, the round cutting blade is rotated, the cutting surface is changed, and finally the round cutting blade is locked by the fastener without replacing cutting knife. Among them, conventional fastener such as screws and bolts may be used as the fasteners.

The beneficial effects of the present invention compared with the prior art are as follows.

1. The structural design of the cutting device is ingenious, the position of the cutting knife may be adjusted by mounting the cutting knife on the sliding block that may move back and forth along the Y-axis direction, so that the integrated paper-plastic bag cutting and sealing machine is not only applied to the traditional paper-plastic bag coded on the outside of the sealing position, but also applied to the paper-plastic bag without coding on the outside of the sealing position, and when the paper-plastic bag without coding on the outside of the sealing position is cut, the problem of wasting a large amount of paper-plastic bag materials brought by the fixed position of the cutting device of the traditional integrated paper-plastic bag cutting and sealing machine is overcome, the production cost is reduced.

2. The position of the cutting knife in the cutting device will move upwards (i.e., moves along the Z-axis direction) under the action of the obliquely upward guiding plate, when the integrated paper-plastic bag cutting and sealing machine is merely used for the sealing operation, avoiding the cutting knife accidentally touching the paper-plastic bag to be sealed, causing damage to the paper-plastic bag.

Figure 1:
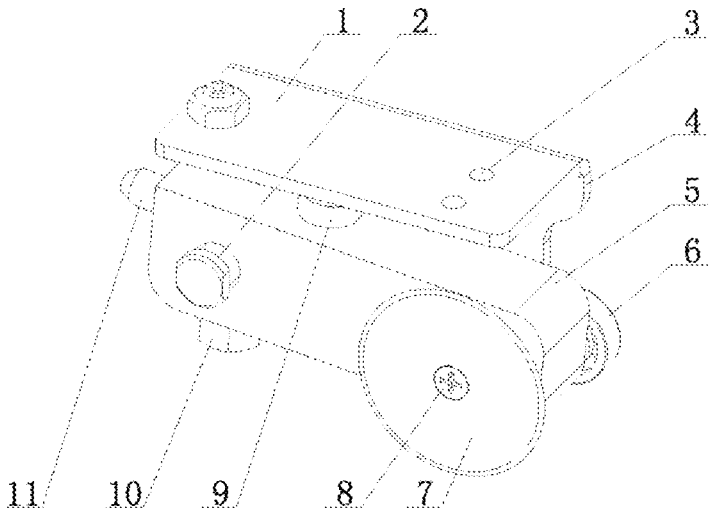
FIG. 1 is a perspective view of the present invention after omitting the pin poking mechanism.
Figure 2:
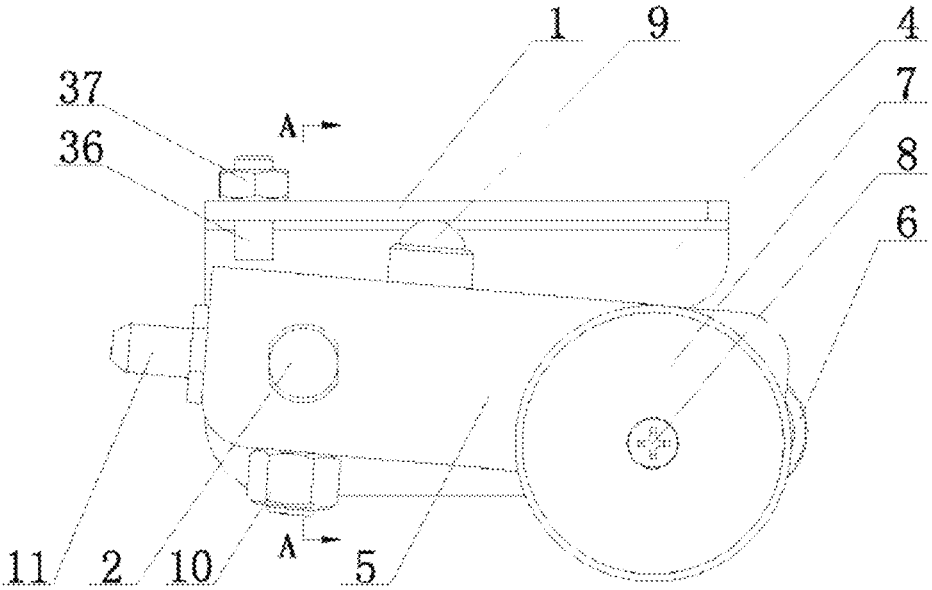
FIG. 2 is a front view of FIG. 1.

In the drawings: 1, upper plate; 2, connecting shaft; 3, fixing member mounting holes; 4, rear plate; 5, sliding block; 6, roller; 7, cutting knife; 8, fastener; 9, spring top bead; 10, spring positioning column; 11, pin; 12, mounting groove; 13, external convex plate; 14, limiting switch; 15, fixing bracket; 16, motor; 17, cutting device; 18, horizontal displacement driving mechanism; 19, sealing device; 20, paper feeding device; 21, pin pull plate; 22, base plate; 23, horizontal sliding groove; 24, photoelectric switch; 25, guiding plate; 26, groove; 27, pin inserting slotted hole; 28, spring; 29, bearing; 30, eccenter; 31, first nut; 32, column body; 33, compression spring; 34, positioning bead; 35, snapping groove; 36, adjusting bolt; 37, second nut; 38, slider.

DETAILED DESCRIPTION

The embodiments of the present invention is further described below with reference to the drawings.

FIG. 1, FIG. 2, FIG. 3, and FIG. 8 are structural schematic views of a cutting device of an integrated paper-plastic bag cutting and sealing machine. The structure of the cutting device is as follows.

Figure 8:
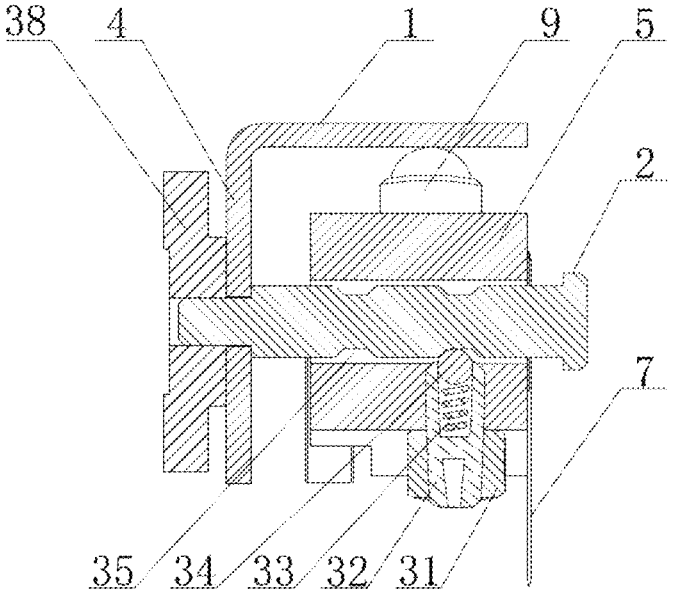
FIG. 8 is an A-A sectional view of FIG. 2.

The cutting device includes a sliding bracket and a cutting knife 7, the sliding bracket is connected to a horizontal displacement driving mechanism 18, the sliding bracket is formed by connecting the upper plate 1 with the rear plate 4 in an L-shape (of course, it may also be directly pressed into one piece), the sliding block 5 is mounted on the rear plate 4 through a connecting shaft 2 and capable of sliding back and forth along the connecting shaft 2, front and rear snapping grooves 35 are arranged on the connecting shaft 2 along the length direction; a spring positioning column 10 is mounted on the sliding block 5, the top end of the spring positioning column 10 passes through the shaft hole wall of the connecting shaft in the sliding block 5 and tightly presses against the connecting shaft 2. The upper plate 1 is mounted with an adjusting bolt 36, a second nut 37 is mounted at a part of the adjusting bolt 36 located above the upper plate 1, the lower end of the adjusting bolt 36 presses against the sliding block 5. The position of the sliding block 5 may be adjusted by the adjusting bolt 36, thereby adjusting the height of the cutting knife 7. A roller 6 is mounted on the lower part of the sliding block 5, the position of the roller 6 is close to the rear plate 4. A round cutting blade is used as the cutting knife 7, the round cutting blade is mounted on the sliding block 5 by a fastener 8 and moves along with the sliding block 5. The lowest position of the round cutting blade is lower than the bottom surface of the sliding block 5. In the present embodiment, the spring positioning column may use the following structure as shown in FIG. 8, specifically, including a column body 32, a compression spring 33 and a positioning bead 34. The column body 32 is screwed into the sliding block 5 from the outside to the inside, the lower part of the column body is tightly locked by the first nut 31. The upper part of the column body 32 is provided with a mounting groove, the compression spring 33 is arranged in the mounting groove. The positioning bead 34 is mounted on the upper end of the compression spring 33. The positioning bead 34 tightly presses against the connecting shaft 2. The diameter of the positioning bead 34 is greater than the depth of the snapping groove 35 on the connecting shaft 2. The left end of the sliding block 5 is provided with a pin 11. A pin poking mechanism is provided corresponding to the pin 11. The pin poking mechanism is not shown in FIG. 1, FIG. 2, or FIG. 8.

FIG. 4 to FIG. 7 are structural schematic views of applying the above-mentioned cutting device to an integrated paper-plastic bag cutting and sealing machine, where the cutting device 17 is mounted on the horizontal displacement driving mechanism 18, after the horizontal displacement driving mechanism 18 is started, the cutting device 17 cuts the paper-plastic bag material along the X-axis direction, the paper-plastic bag obtained after cutting is driven to enter the sealing device 19 at the right side for sealing along the X-axis direction by the belts of the dual-belt conveying mechanism in the paper feeding device 20. A series of actions of cutting and sealing paper-plastic bag may be realized through the integrated paper-plastic bag cutting and sealing machine.

Figure 3:
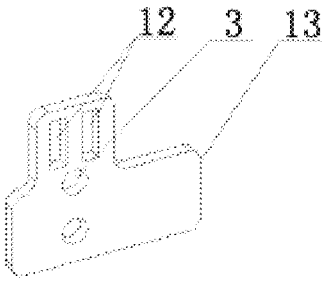
FIG. 3 is a structural schematic view of the upper pressing plate.
Figure 4:
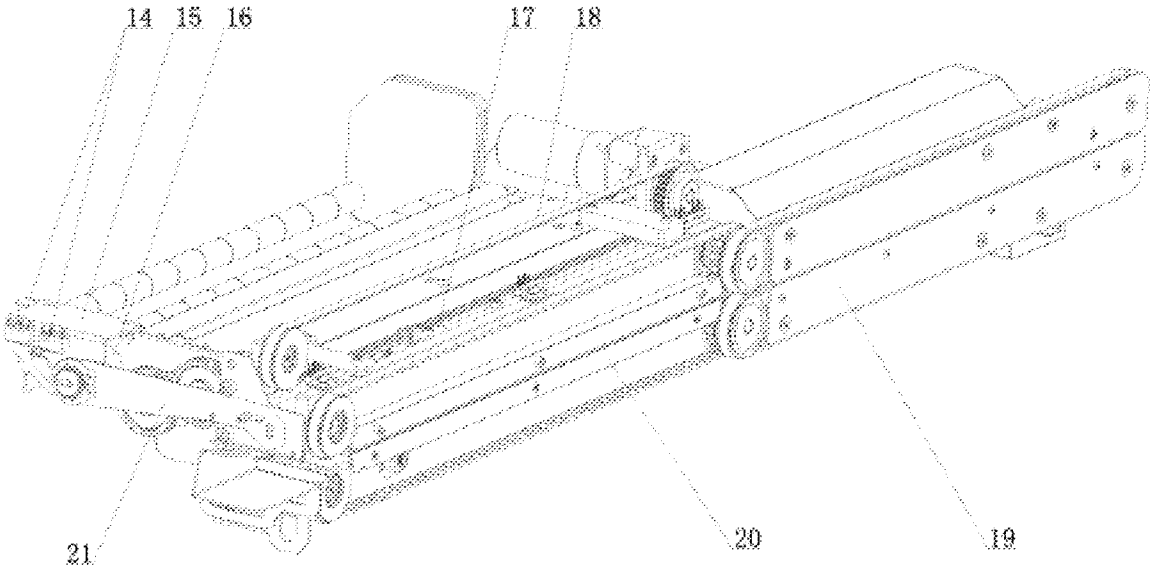
FIG. 4 is a perspective view of the present invention applied to a integrated paper-plastic bag cutting and sealing machine.
Figure 5:
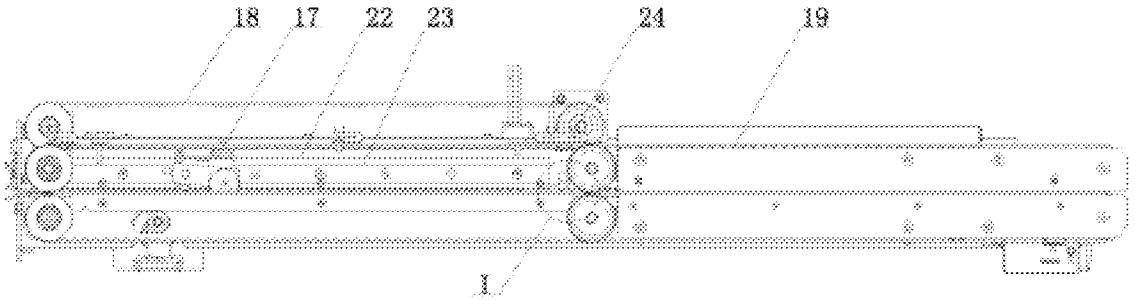
FIG. 5 is a structural schematic view of a front view of the present invention applied to the integrated paper-plastic bag cutting and sealing machine.
Figure 6:
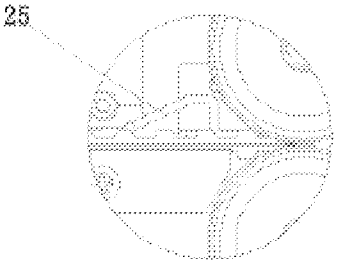
FIG. 6 is a partial enlarged view of the part I of FIG. 5.
Figure 7:
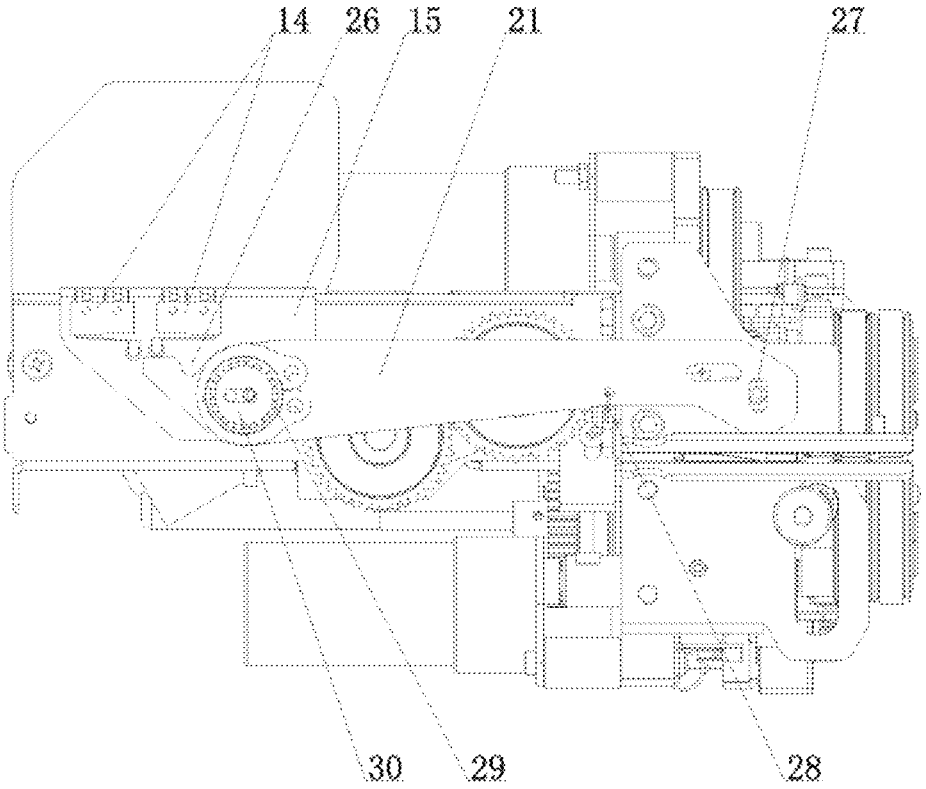
FIG. 7 is a structural schematic view of the left view of the present invention applied to the integrated paper-plastic bag cutting and sealing machine.

In this embodiment:

The horizontal displacement driving mechanism 18 uses a pulley transmission mechanism, the sliding bracket further includes an upper pressing plate (the structure thereof is shown in FIG. 3). The upper pressing plate is located above the upper plate 1, the upper pressing plate is provided with a mounting groove 12 used to assemble with the transmission belt in the pulley transmission mechanism. The transmission belt is located between the upper pressing plate and the upper plate 1. Fixing member mounting holes 3 corresponding to each other are respectively arranged on the upper pressing plate and the upper plate 1. The fixing member is mounted in the fixing member mounting hole 3. The upper pressing plate is fixedly connected to the upper plate 1, so that the cutting device 17 is driven to move along the X-axis direction through the transmission belt to complete the cutting of the paper-plastic bag. A base plate 22 is mounted behind the pulley transmission mechanism, the base plate 2 is provided with a horizontal sliding groove 23. The back surface of the rear plate 4 of the sliding bracket is provided with a slider 38. The slider 38 is located in the horizontal sliding groove 23 and may slide left and right along the X-axis direction in the horizontal sliding groove 23. The horizontal sliding groove 23 plays a good guiding role for the sliding bracket.

The pin poking mechanism includes a pin pull plate 21, a cam, a motor 16 and a fixing bracket 15. The motor 16 is mounted on the fixing bracket 15. A cam is mounted on an output shaft of the motor 16. In this embodiment, an eccenter 30 is used as the cam. The pin pull plate 21 is provided with an eccentric hole matching the eccenter 30. The eccenter 30 is assembled in the eccentric hole through the bearing 29. The rotation action of the output shaft of the motor 16 is converted into the forward and backward movement of the pin pull plate 21 along the Y-axis direction by the eccenter 30. A pin inserting slotted hole 27 is arranged at one end of the pin pull plate 21 near the pin 11. The diameter of the pin inserting slotted hole 27 is larger than the diameter of the pin 11. Before the position of the cutting knife 7 is adjusted, the pin 11 on the sliding block 5 needs to be inserted into the pin inserting slotted hole 27 at the front end of the pin pull plate 21, ensuring the cutting knife 7 changes position along with the back and forth movement of the pin pull plate 21. In the abnormal situation, if the pin 11 on the left side of the sliding block 5 is laterally non-coaxial with the pin inserting slotted hole 27 at the front end of the pin pull plate 21, when the sliding bracket moves to the leftmost position, the pin 11 on the sliding block 5 cannot be inserted into the pin inserting slotted hole 27 at the front end of the pin pull plate 21. At this time, motor 16 needs to be started, the pin pull plate 21 is finally driven to move by the motor 16, so that the pin 11 is inserted into the pin inserting slotted hole 27. The front and rear limiting switches 14 are mounted on the fixing bracket 15 along the Y-axis direction, the two limiting switches 14 and the motor 16 are all connected to the control system of the integrated paper-plastic bag cutting and sealing machine. The limiting switch 14 may directly use the conventional contact switch. A groove 26 is formed on the upper surface of the pin pull plate 21. When the pin pull plate 21 moves backward along the Y-axis direction to the rear contact switch, the front contact switch is just located in the groove 26. One end of the spring 28 is fixed on the plate surface of the pin pull plate 21 close to the sliding bracket through the fixing member, the other end of the spring 28 is mounted on a rack of the integrated paper-plastic bag cutting and sealing machine.

An obliquely upward guiding plate 25 and photoelectric switch 24 are mounted on the rack of the integrated paper-plastic bag cutting and sealing machine. The photoelectric switch 24 is connected to the control system of the integrated paper-plastic bag cutting and sealing machine. The side of the upper pressing plate close to the guiding plate 25 is provided with an external convex plate 13 (the external convex plate 13 may also be arranged on other structures of the sliding bracket, such as the side of the upper plate 1 close to the guiding plate 25). When the sliding block 5 moves upward along the guiding plate 25 to a position that a cutting surface of the cutting knife 7 is higher than a plane of a paper-plastic bag in a paper feeding device 20 of the integrated paper-plastic bag cutting and sealing machine, the photoelectric switch 24 may sense the external convex plate 13. When the integrated paper-plastic bag cutting and sealing machine is merely used for sealing operation, the position of the cutting knife 7 may be moved upwards through this solution, thereby effectively avoid the cutting knife 7 accidentally touching the paper-plastic bag to be sealed and damage to the paper-plastic bag.

The movement of the cutting knife 7 along three directions of X-axis, Y-axis and Z-axis may be realized through the cutting device 17 described in the present invention.

(1) Under the driving of the transmission belt of the pulley transmission mechanism, the cutting knife 7 may move left and right along the X-axis direction.

(2) Under the action of the pin poking mechanism, the cutting knife 7 may move back and forth along the Y-axis direction. The specific process is as follows.

When the cutting knife 7 needs to be adjusted from the front to the rear (along the Y-axis direction), the sliding bracket is firstly moved to the left side of the pin pull plate 21, the pin 11 on the sliding block 5 is inserted into the pin inserting slotted hole 27 at the front end of the pin pull plate 21. And then the motor 16 is started by the control system, the pin pull plate 21 is driven to move backward by the eccenter 30. When the pin pull plate 21 moves to the most rear, the spring positioning column 10 on the sliding block 5 just reaches the position of the snapping groove 35 at the rear of the connecting shaft 2 and springs into the snapping groove 35. Meanwhile, the rear end of the pin pull plate 21 just reaches the position of the rear limiting switch 14. At this time, the limiting switch 14 transmits the signal to the control system of the integrated paper-plastic bag cutting and sealing machine. The control system stops the motor 16, the sliding block 5 stops moving to achieve the positioning of the cutting knife 7. When the cutting knife 7 is in this position, the cutting device is applied to cut the traditional paper-plastic bag coded on the outside of the sealing position. When the paper-plastic bag to be cut is not required to be coded on the outside of the sealing position, the cutting knife 7 needs to be adjusted from rear to front, the sliding bracket also needs to be moved to the side of the pin pull plate 21 before operation, so that the pin 11 is inserted into the pin inserting slotted hole 27. And then the motor 16 is started to make the pin pull plate 21 move to the forefront. At this time, the spring positioning column 10 on the sliding block 5 springs into the snapping groove 35 in the front part of the connecting shaft 2, meanwhile, the rear end of the pin pull plate 21 just reaches the position of the front limiting switch 14. The control system stops the motor 16, the cutting knife 7 is positioned so that the position of the cutting knife 7 (i.e., the cutting position) advances. The distance between the sealing position on the paper-plastic bag after being cut and the edge of the paper-plastic bag will be reduced, effectively overcoming the problem of the large amount of wasted paper-plastic bag materials caused by the fixed position of the cutting device in the traditional integrated paper-plastic bag cutting and sealing machine, reducing the production cost.

(3) The cutting knife 7 may move up and down along the Z-axis direction under the action of the obliquely upward guiding plate 25, the specific process is as follows.

The horizontal displacement driving mechanism 18 is activated by the control system, the whole cutting device 17 is driven to move to the guiding plate 25 along the X-axis direction. When the cutting device reaches the position where the guide plate 25 is located, the sliding block 5 with the roller 6 moves obliquely upward along the guiding plate 25. The position of the cutting knife 7 on the sliding block 5 is raised (moves along the Z-axis direction) so that the cutting surface of the cutting knife 7 is higher than the plane of the paper-plastic bag in the paper feeding device 20. At this time, the photoelectric switch 24 senses the external convex plate 13 and transmits the signal to the control system, the control system stops the movement of the horizontal displacement driving mechanism 18, finally the entire cutting device 17 stops moving. When the cutting device needs to cut the paper-plastic bag material, the control system starts the horizontal displacement driving mechanism 18, the cutting device 17 is driven to move oppositely along the X-axis direction (i.e., the direction away from the guiding plate 25).

In a practical application, a spring top bead 9 may further be mounted on the top of the sliding block 5. During the movement of the cutting knife 7 along the guiding plate 25, the spring top bead 9 is in a compressed state. When the cutting action needs to be performed by the cutting knife 7, the horizontal displacement driving mechanism 18 is activated by the control system, the whole cutting device 17 is driven to move away from the guiding plate 25 along the X-axis. During the movement, the spring top bead 9 exerts a downward force to the sliding block 5 under the elastic action of its own, so that the sliding block 5 is deflected downwardly around the connecting shaft 2 under the action of the spring top bead 9, the position of the cutting knife 7 is reduced until the cutting knife 7 returns to the initial position (i.e., the position of the cutting knife 7 in the cutting state).

What is claimed is:

1. A cutting device of an integrated paper-plastic bag cutting and sealing machine, comprising:

a sliding bracket and a cutting knife, wherein the sliding bracket is connected to a horizontal displacement driving mechanism, the sliding bracket is formed by connecting an upper plate with a rear plate (4), a sliding block is mounted on the rear plate through an connecting shaft and the sliding block is able to slide back and forth along the connecting shaft, a front snapping groove and a rear snapping groove are arranged on the connecting shaft (2) along a length direction; the cutting knife is mounted on the sliding block, a lowest position of the cutting knife is lower than a bottom surface of the sliding block; a spring positioning column is mounted on the sliding block, a top end of the spring positioning column passes through a shaft hole wall of the connecting shaft of the sliding block and tightly presses against the connecting shaft.

2. The cutting device of the integrated paper-plastic bag cutting and sealing machine according to claim 1, wherein the horizontal displacement driving mechanism uses a pulley transmission mechanism, the sliding bracket further comprises an upper pressing plate, the upper pressing plate is located above the upper plate, the upper pressing plate is provided with a mounting groove for an assembly of a transmission belt in the pulley transmission mechanism, the transmission belt of the pulley transmission mechanism is placed between the upper pressing plate and the upper plate, the upper pressing plate is fixedly connected to the upper plate through a fixing member.

3. The cutting device of the integrated paper-plastic bag cutting and sealing machine according to claim 2, wherein the sliding block is provided with a pin on the a left end surface or right end surface along a X-axis direction, a pin poking mechanism is provided corresponding to the pin.

4. The cutting device of the integrated paper-plastic bag cutting and sealing machine according to claim 2, wherein an obliquely upward guiding plate and a photoelectric switch are mounted on the rack of the integrated paper-plastic bag cutting and sealing machine, the photoelectric switch is connected to a control system of the integrated paper-plastic bag cutting and sealing machine, a side of the sliding bracket close to the guiding plate is provided with an external convex plate, when the sliding block moves upward along the guiding plate to a position that a cutting surface of the cutting knife is higher than a plane of a paper-plastic bag in a paper feeding device of the integrated paper-plastic bag cutting and sealing machine, the photoelectric switch senses the external convex plate.

5. The cutting device of the integrated paper-plastic bag cutting and sealing machine according to claim 2, wherein a base plate is mounted behind the pulley transmission mechanism, a horizontal sliding groove is arranged on the base plate, a slider is arranged on a back surface of the rear plate of the sliding bracket, the slider is located in the horizontal sliding groove and slides left and right in the horizontal sliding groove along a X-axis direction.

6. The cutting device of the integrated paper-plastic bag cutting and sealing machine according to claim 5, wherein the sliding block is provided with a pin on the a left end surface or right end surface along the X-axis direction, a pin poking mechanism is provided corresponding to the pin.

7. The cutting device of the integrated paper-plastic bag cutting and sealing machine according to claim 5, wherein an obliquely upward guiding plate and a photoelectric switch are mounted on the rack of the integrated paper-plastic bag cutting and sealing machine, the photoelectric switch is connected to a control system of the integrated paper-plastic bag cutting and sealing machine, a side of the sliding bracket close to the guiding plate is provided with an external convex plate, when the sliding block moves upward along the guiding plate to a position that a cutting surface of the cutting knife is higher than a plane of a paper-plastic bag in a paper feeding device of the integrated paper-plastic bag cutting and sealing machine, the photoelectric switch senses the external convex plate.

8. The cutting device of the integrated paper-plastic bag cutting and sealing machine according to claim 1, wherein an adjusting bolt is mounted on the upper plate, a part of the adjusting bolt above the upper plate is mounted with a second nut, a lower end of the adjusting bolt presses against the sliding block.

9. The cutting device of the integrated paper-plastic bag cutting and sealing machine according to claim 8, wherein the sliding block is provided with a pin on the a left end surface or right end surface along a X-axis direction, a pin poking mechanism is provided corresponding to the pin.

10. The cutting device of the integrated paper-plastic bag cutting and sealing machine according to claim 8, wherein an obliquely upward guiding plate and a photoelectric switch are mounted on the rack of the integrated paper-plastic bag cutting and sealing machine, the photoelectric switch is connected to a control system of the integrated paper-plastic bag cutting and sealing machine, a side of the sliding bracket close to the guiding plate is provided with an external convex plate, when the sliding block moves upward along the guiding plate to a position that a cutting surface of the cutting knife is higher than a plane of a paper-plastic bag in a paper feeding device of the integrated paper-plastic bag cutting and sealing machine, the photoelectric switch senses the external convex plate.

11. The cutting device of the integrated paper-plastic bag cutting and sealing machine according to claim 1, wherein the sliding block is provided with a pin on a left end surface or right end surface along a X-axis direction, a pin poking mechanism is provided corresponding to the pin.

12. The cutting device of the integrated paper-plastic bag cutting and sealing machine according to claim 11, wherein an obliquely upward guiding plate and a photoelectric switch are mounted on the rack of the integrated paper-plastic bag cutting and sealing machine, the photoelectric switch is connected to a control system of the integrated paper-plastic bag cutting and sealing machine, a side of the sliding bracket close to the guiding plate is provided with an external convex plate, when the sliding block moves upward along the guiding plate to a position that a cutting surface of the cutting knife is higher than a plane of a paper-plastic bag in a paper feeding device of the integrated paper-plastic bag cutting and sealing machine, the photoelectric switch senses the external convex plate.

13. The cutting device of the integrated paper-plastic bag cutting and sealing machine according to claim 11, wherein the pin poking mechanism comprises a pin pull plate, a cam, a motor and a fixing bracket, the motor is mounted on the fixing bracket, the cam is mounted on an output shaft of the motor, the pin pull plate is assembled with the cam and driven by the cam to achieve a forth and back displacement along a Y-axis direction, an end of the pin pull plate close to the pin is provided with a pin inserting slotted hole, a hole diameter of the pin inserting slotted hole is larger than a diameter of the pin, a front limiting switch and a rear limiting switch are mounted on the fixing bracket along the Y-axis direction, the front limiting switch, the rear limiting switch and the motor are all connected to a control system of the integrated paper-plastic bag cutting and sealing machine.

14. The cutting device of the integrated paper-plastic bag cutting and sealing machine according to claim 13, wherein a first end of the spring is fixed on a plate surface of the pin pull plate close to the sliding bracket through the fixing member, a second end of the spring is mounted on a rack of the integrated paper-plastic bag cutting and sealing machine.

15. The cutting device of the integrated paper-plastic bag cutting and sealing machine according to claim 13, wherein an obliquely upward guiding plate and a photoelectric switch are mounted on the rack of the integrated paper-plastic bag cutting and sealing machine, the photoelectric switch is connected to the control system of the integrated paper-plastic bag cutting and sealing machine, a side of the sliding bracket close to the guiding plate is provided with an external convex plate, when the sliding block moves upward along the guiding plate to a position that a cutting surface of the cutting knife is higher than a plane of a paper-plastic bag in a paper feeding device of the integrated paper-plastic bag cutting and sealing machine, the photoelectric switch senses the external convex plate.

16. The cutting device of the integrated paper-plastic bag cutting and sealing machine according to claim 13, wherein each of the front limiting switch and the rear limiting switch is a contact switch, an upper surface of the pin pull plate is provided with a groove, when the pin pull plate moves backward to a rear contact switch along the Y-axis direction, a front contact switch is located in the groove.

17. The cutting device of the integrated paper-plastic bag cutting and sealing machine according to claim 16, wherein an obliquely upward guiding plate and a photoelectric switch are mounted on the rack of the integrated paper-plastic bag cutting and sealing machine, the photoelectric switch is connected to the control system of the integrated paper-plastic bag cutting and sealing machine, a side of the sliding bracket close to the guiding plate is provided with an external convex plate, when the sliding block moves upward along the guiding plate to a position that a cutting surface of the cutting knife is higher than a plane of a paper-plastic bag in a paper feeding device of the integrated paper-plastic bag cutting and sealing machine, the photoelectric switch senses the external convex plate.

18. The cutting device of the integrated paper-plastic bag cutting and sealing machine according to claim 13, wherein the cam uses an eccenter, the pin pull plate is provided with an eccentric hole matched with the eccenter, the eccenter is assembled in the eccentric hole through a bearing.

19. The cutting device of the integrated paper-plastic bag cutting and sealing machine according to claim 18, wherein an obliquely upward guiding plate and a photoelectric switch are mounted on the rack of the integrated paper-plastic bag cutting and sealing machine, the photoelectric switch is connected to the control system of the integrated paper-plastic bag cutting and sealing machine, a side of the sliding bracket close to the guiding plate is provided with an external convex plate, when the sliding block moves upward along the guiding plate to a position that a cutting surface of the cutting knife is higher than a plane of a paper-plastic bag in a paper feeding device of the integrated paper-plastic bag cutting and sealing machine, the photoelectric switch senses the external convex plate.

20. The cutting device of the integrated paper-plastic bag cutting and sealing machine according to claim 1, wherein an obliquely upward guiding plate and a photoelectric switch are mounted on the rack of the integrated paper-plastic bag cutting and sealing machine, the photoelectric switch is connected to a control system of the integrated paper-plastic bag cutting and sealing machine, a side of the sliding bracket close to the guiding plate is provided with an external convex plate, when the sliding block moves upward along the guiding plate to a position that a cutting surface of the cutting knife is higher than a plane of a paper-plastic bag in a paper feeding device of the integrated paper-plastic bag cutting and sealing machine, the photoelectric switch senses the external convex plate.

* * * * *